US006547353B2

(12) United States Patent
Hopkins

(10) Patent No.: US 6,547,353 B2
(45) **Date of Patent: *Apr. 15, 2003**

(54) THERMAL INK JET PRINTHEAD SYSTEM WITH MULTIPLE OUTPUT DRIVER CIRCUIT FOR POWERING HEATING ELEMENT AND ASSOCIATED METHOD

(75) Inventor: Thomas L. Hopkins, Mundelein, IL (US)

(73) Assignee: STMicroelectronics, Inc., Carrollton, TX (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/361,705

(22) Filed: Jul. 27, 1999

(65) Prior Publication Data

US 2002/0033864 A1 Mar. 21, 2002

(51) Int. Cl.[7] ..... B41J 29/38; G05F 3/26

(52) U.S. Cl. ..... 347/12; 323/281; 323/316

(58) Field of Search ..... 347/59, 5, 9, 12, 347/20, 56, 57, 211, 237, 240, 247; 323/265–269, 311–317, 349–354, 274, 280, 281

(56) References Cited

U.S. PATENT DOCUMENTS

| | | | | |
|---|---|---|---|---|
| 4,728,901 A | | 3/1988 | Pepper | 330/260 |
| 4,825,102 A | * | 4/1989 | Iwasawa et al. | 327/546 |
| 4,841,486 A | | 6/1989 | Minato et al. | 365/207 |
| 5,010,355 A | | 4/1991 | Hawkins et al. | 347/64 |
| 5,018,041 A | | 5/1991 | Szepesi | 361/18 |
| 5,075,250 A | | 12/1991 | Hawkins et al. | 438/21 |
| 5,081,473 A | | 1/1992 | Hawkins et al. | 347/59 |
| 5,099,192 A | * | 3/1992 | Thayer et al. | 323/315 |
| 5,107,199 A | * | 4/1992 | Vo et al. | 323/316 |
| 5,258,638 A | | 11/1993 | Elhatem et al. | 257/401 |
| 5,272,392 A | | 12/1993 | Wong et al. | 327/109 |
| 5,371,530 A | * | 12/1994 | Hawkins et al. | 347/9 |
| 5,457,311 A | | 10/1995 | Drake et al. | 250/208.1 |
| 5,541,799 A | | 7/1996 | Schmidt et al. | 361/18 |
| 5,578,956 A | | 11/1996 | Rossi et al. | 327/309 |
| 5,804,958 A | | 9/1998 | Tsui et al. | 323/313 |
| 5,831,910 A | | 11/1998 | Suzuki et al. | 365/189.11 |

* cited by examiner

*Primary Examiner*—Judy Nguyen
*Assistant Examiner*—Blaise Mouttet
(74) *Attorney, Agent, or Firm*—Lisa K. Jorgenson; Christopher F. Regan

(57) ABSTRACT

A thermal ink jet printhead system has a printhead with base member and a plurality of ink flow channels formed in the base member that connect to an ink reservoir and terminate in a nozzle through which ink is expelled. A heating element is associated with each ink flow channel. A monolithically integrated multiple output power driver circuit is formed as a semiconductor integrated circuit and connected to each heating element in the printhead. The multiple output driver circuit includes a power MOS transistor connected to each heating element. A reference circuit is operatively connected to each gate of the power MOS transistor and includes a reference transistor having a gate and a reference amplifier that receives as inputs a reference voltage and a source of current. An amplifier output is operatively connected to the gates of the power output transistors and the gate of the reference transistor. The reference amplifier regulates the reference transistor directly and the power MOS transistors by matching.

18 Claims, 2 Drawing Sheets

THERMAL INK JET PRINTHEAD SYSTEM WITH MULTIPLE OUTPUT DRIVER CIRCUIT FOR POWERING HEATING ELEMENT AND ASSOCIATED METHOD

FIELD OF THE INVENTION

This invention relates to the field of thermal ink jet printhead systems, and more particularly, this invention relates to a multiple output driver circuit used for driving heat elements associated with thermal ink jet printhead systems.

BACKGROUND OF THE INVENTION

Modern ink jet printing systems use a printhead having a plurality of ink flow channels that connect with an ink reservoir. Each ink flow channel terminates in a nozzle through which ink is expelled. A heating element, usually formed as a resistor, is associated with each ink flow channel. This heating element is usually positioned at the bottom portion of the ink flow channels and spaced a predetermined distance from the nozzle. A power driver circuit supplies a pulse of current to each heating element at a predetermined time, thus heating the heating element. As a result, the ink vaporizes and forms an ink bubble. As this ink bubble grows, the ink is ejected out of the nozzle. When the current from the power driver circuit is stopped, the heating element cools and the ink bubble collapses. The ink located at the vicinity of the nozzle is then pulled back into the nozzle and into the ink flow channel, resulting in an ink drop that ejects from the nozzle by separation of that portion of the ink located outside of the nozzle from that portion of the ink located inside the nozzle. Usually the power driver circuit is formed as a power output transistor (such as a power MOS transistor) that drives the heating element formed as a resistor. A logic circuit connects to the power output transistor and signals when the power output transistor should turn on to heat the respective heating element.

The energy delivered to the resistor must be controlled. Thus, it is important to measure and predict accurately the energy that is obtained when a resistor is "fired", i.e., heated, to vaporize and eject ink from the nozzle. Temperature fluctuations during the printing process often cause variations in energy. Usually, there are twenty to fifty nozzles located within a printhead, with one resistor per nozzle. Thus, the temperature fluctuations can vary by as much as 10% or 15%.

In some prior art applications, a ballast resistor was used. It was driven from a 24 volt supply and power was drawn down to the top of the nozzles. An FET transistor, a power MOS transistor, was turned on. A variation in the $V_{DS}$ with the power MOS transistor represented a variation in the energy. It is necessary to obtain better control of the $V_{DS}$ of the transistor. The energy delivered to the resistor is effected by the $R_{DS}$ for the "on" position of a device, and thus, it is desirable to control the voltage drop across the transistor output.

One prior art technique is shown in FIG. 2, which illustrates a technique to sense the output voltage of each power transistor when the transistor is "on." That voltage is compared to a reference and the gate of the power transistor, usually formed as a power MOS transistor, is controlled so that the output voltage is regulated. However, this system has several disadvantages because it requires an amplifier for each power MOS transistor. The amplifier must have a very high bandwidth when used in a power driver application where output pulses are 2–4 microseconds wide. This technique also requires one amplifier circuit per transistor and requires much area on the semiconductor circuit die.

SUMMARY OF THE INVENTION

It is therefore an object of the present invention to provide a multiple output thermal ink jet printhead driver that does not require an amplifier circuit per each power output transistor.

It is still another object of the present invention to provide a multiple output driver circuit, such as for driving a thermal ink jet printhead, which uses only one reference circuit to regulate the $R_{DS}$ on a reference transistor and the $R_{DS}$ of a power output transistor, such as a power MOS transistor.

In accordance with the present invention, a thermal ink jet printhead has a base member. A plurality of ink flow channels are positioned in the base member and connect with an ink reservoir. The ink flow channels terminate in a nozzle through which ink is expelled. A heating element is associated with each ink flow channel. A multiple output driver circuit is connected to the thermal ink jet printhead and is formed as a semiconductor integrated circuit.

The multiple output driver circuit includes a power output transistor connected to each heating element. Each of the power output transistors includes a gate. A reference circuit is operatively connected to each gate of each power output transistor. The reference circuit includes a reference transistor having a gate and a reference amplifier that receives a reference voltage and a source of current. An amplifier output is operatively connected to the gates of the power output transistors and the gate of the reference transistor. The reference amplifier regulates the reference transistor directly and the power output transistors by matching.

In still another aspect of the present invention, a logic circuit is operatively connected to each of the gates of the power output transistors. The logic circuit can be monolithically formed with the semiconductor integrated circuit. The heating element connected to each ink flow channel comprises a resistor in one preferred aspect of the invention. The resistors can be monolithically formed with the printhead.

In still another aspect of the present invention, the plurality of power output transistors each comprise a power MOS transistor. A gate driver circuit is directly connected to each gate of each power output transistor and is typically formed as a push/pull transistor circuit. Each power output transistor can include a source terminal connected to ground and a drain terminal connected to a voltage supply.

In still another aspect of the present invention, a method of operating a thermal ink jet printhead is disclosed and claimed. The method operates a thermal ink jet printhead and comprises the steps of regulating a reference transistor of a reference circuit directly, while matching with the reference circuit a plurality of power output transistors that are connected to a resistor of a thermal ink jet printhead. The reference transistor of the reference circuit and the power output transistors can be monolithically formed as a semiconductor integrated circuit. Logic signals are input to gate drivers that are connected to each of each power output transistor to turn on respective power output transistors. The power output transistors can be formed as power MOS transistors.

BRIEF DESCRIPTION OF THE DRAWINGS

Other objects, features and advantages of the present invention will become apparent from the detailed description of the invention which follows, when considered in light of the accompanying drawings in which.

DETAILED DESCRIPTION OF THE PREFERRED EMBODIMENTS

The present invention is advantageous because it now provides a multiple output driver circuit that has a regulated $V_{DS}$ at the output of a power output transistor where a single point, such as in a reference circuit, is regulated and mirrors other outputs. Thus, one amplifier does not have to be used per power output transistor.

As is well known to those skilled in the art, ink jet print systems use a printhead that includes an ink reservoir that connects to ink flow channels, which terminate in a nozzle through which ink is expelled. Heating elements formed as a resistor are connected to each ink flow channel. A power driver circuit drives the resistor to heat the resistor and vaporize ink within the ink flow channel. An ink bubble is formed. As the ink bubble enlarges, ink is ejected out of the nozzle. When the power driver circuit is turned off, the resistor cools, causing the ink bubble to collapse. Ink outside the nozzle is separated from ink inside the nozzle, and thus ejected.

Figure 1:
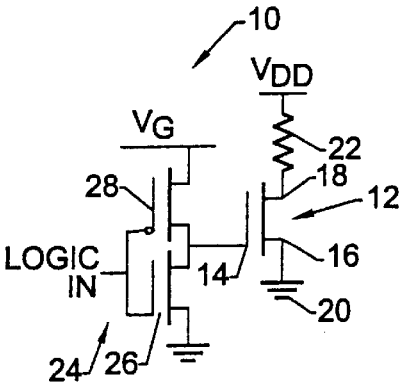
FIG. 1. (PRIOR ART)
FIG. 1 illustrates a power driver circuit for a heating element used in a thermal ink jet printhead that has no temperature compensation circuit.

FIG. 1 illustrates a conventional power driver circuit 10 formed with a power output transistor 12 having a gate 14, source 16 and drain 18. The power output transistor in this conventional circuit could be a power MOS transistor, as is well known to those skilled in the art. The source 16 is connected to ground 20 and the drain 18 is connected to the heating element formed as a resistor 22 which, in turn, is connected to the voltage supply $V_{DD}$. A gate driver circuit 24 is formed as a push/pull transistor driver circuit with first and second transistors 26,28, as is known to those skilled in the art. It is connected to the gate 14 of the power output transistor 12. The gate driver circuit 24 is connected to ground 20 and to a source of gate voltage ($V_G$). A logic signal is input from a logic circuit (not shown) and turns the power output transistor on and off to generate current to the resistor 22 to heat the heating element.

It is evident that this prior art power driver circuit as shown in FIG. 1 has no temperature compensation. Because these power driver circuits are connected to thermal ink jet printheads, the temperature fluctuations can vary by as much as 10% to 15%, especially where output pulses are 2–4 microseconds wide.

Figure 2:
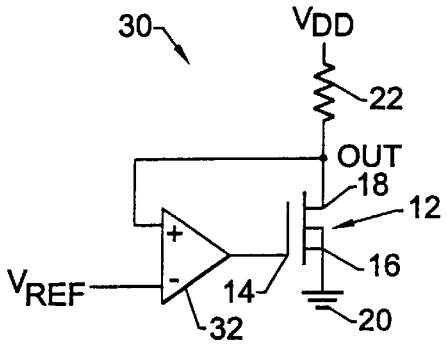
FIG. 2. (PRIOR ART)
FIG. 2 illustrates one prior art power driver circuit used for a thermal ink jet printhead using one amplifier as a reference per single power output transistor.

FIG. 2 illustrates another prior art power driver circuit 30 that solves this problem by using a reference amplifier 32 having a voltage reference as an input and an output from the drain 18 of the power output transistor 12 that is used as an input back into the amplifier 32. The gate 14 of the power output transistor 12 is then varied so that the output voltage is regulated. However, as noted before, this type of system requires an amplifier 32 for each power output transistor 12. The amplifier 32 must have a very high bandwidth when used in the ink jet printer applications, where output pulses are 2–4 microseconds wide. This technique also requires one amplifier circuit per power output transistor, and therefore, requires much area on a semiconductor circuit die.

The present invention overcomes these problems by using a closed loop reference circuit (FIG. 4) that is connected in open loop configuration to each of the gates of a power output transistor via a push/pull gate driver circuit to form a multiple output driver circuit.

Figure 3:
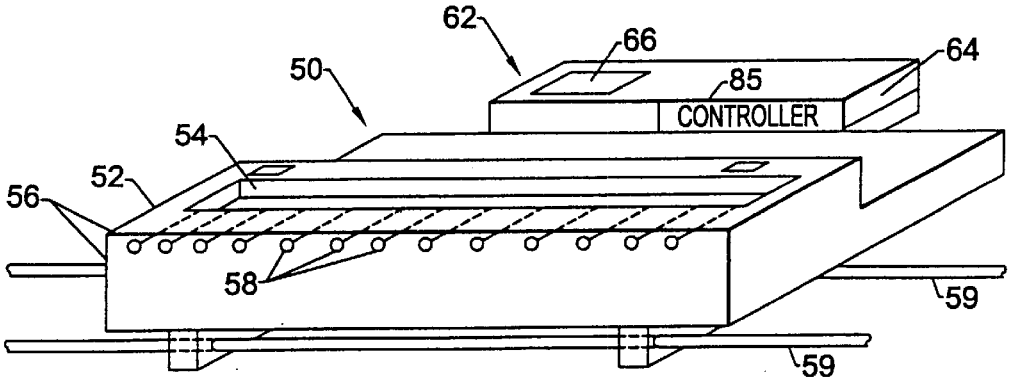
FIG. 3 is a schematic, isometric view of a thermal ink jet printhead system of the present invention showing a multiple output driver circuit connected to a thermal ink jet printhead and formed as a semiconductor integrated circuit on a semiconductor substrate.
Figure 4:
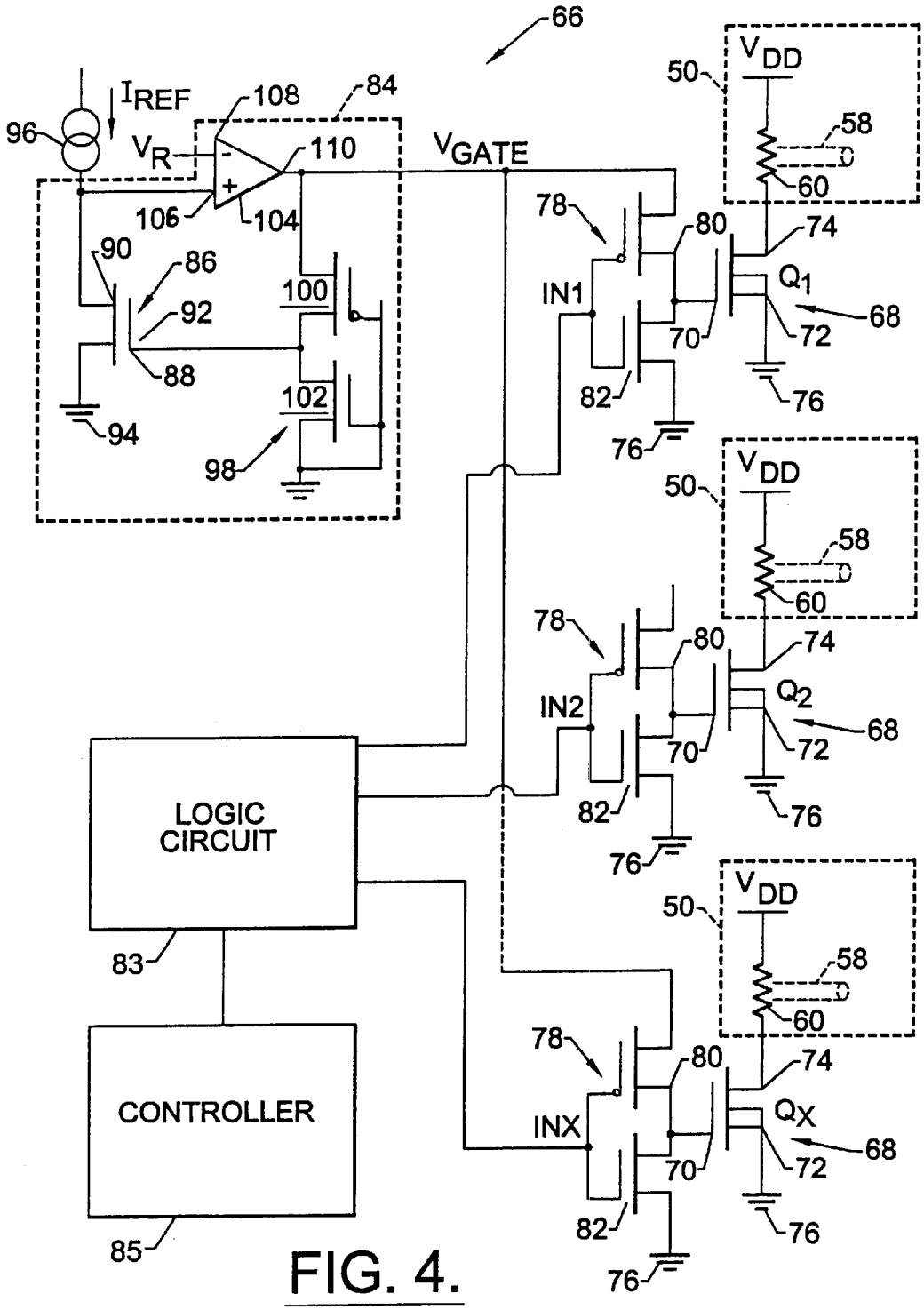
FIG. 4 is a schematic circuit diagram of a multiple output driver circuit of the present invention.

Referring now to FIG. 3, there is illustrated a thermal ink jet printhead 50 of the present invention, which includes a base member 52 having an ink reservoir 54 and a plurality of ink flow channels 56 that extend from the ink reservoir 54 and terminate in nozzles 58 through which ink is expelled. The printhead 50 is slidable on mounting bars 59 as is known to those skilled in the art. A heating element is formed as a resistor 60 and is connected to each ink flow channel as shown in FIG. 4. A semiconductor substrate, shown by dashed line configuration 62, is connected to the base member and includes an integrated circuit chip or die 64 that includes a multiple output driver circuit 66 (FIG. 4) that connects to the thermal ink jet printhead 50.

Further details of different ink jet printhead configurations and types of circuits can be found in U.S. Pat. No. 5,075,250, issued Dec. 24, 1991; U.S. Pat. No. 5,081,473, issued Jan. 14, 1992; U.S. Pat. No. 5,258,638, issued Nov. 2, 1993; and U.S. Pat. No. 5,371,530, issued Dec. 6, 1994, the references and disclosures which are hereby incorporate by reference in their entirety.

FIG. 4 illustrates the multiple output driver circuit 66 that is monolithically integrated and connected to the thermal ink jet printhead 50. In the drawing figure, the resistor 60 and nozzle 58 are separate and not monolithically formed with the output driver circuit. The circuit 66 includes a plurality of power output transistors 68 formed as power MOS transistors that are connected to each heating element formed as a resistor 60, as is well known to those skilled in the art. Each power MOS transistor includes a gate 70, source 72 and drain 74. The illustrated embodiment of FIG. 4 shows three power MOS transistors 68 labeled $Q_1$, $Q_2$ and $Q_X$. The dotted line configuration illustrates that more power MOS transistors are included for a plurality of nozzles as is necessary. Typically, a thermal ink jet printhead includes about 50 nozzles, and thus, 50 power MOS transistors would be associated with respective nozzles and resistors.

The source 72 of each power MOS transistor 68 is connected to ground 76 and its drain 74 is connected to the resistor 60 which, in turn, is connected to the voltage source ($V_{DD}$).

A gate driver circuit 78 is connected to the gate 70 of each power MOS transistor 68 and is formed from a push/pull transistor driver circuit that includes first and second transistors 80,82 as is known to those skilled in the art. The push/pull transistor driver circuit 80,82 is connected to a logic circuit 83 and controller 85 that provides logic pulses for turning on and off each power MOS transistor via the push/pull transistor driver circuit 80,82, operating as a gate driver. The plurality of power MOS transistors 68 and gate driver circuits 78 are substantially similar to each other and monolithically formed as one semiconductor die or chip by processing techniques well known to those skilled in the art. Naturally, the resistor 60, although not monolithically formed with the driver circuit, are similar to each other.

In accordance with the present invention, a closed loop reference circuit 84 is operatively connected to each of the gate driver circuits 78 of each power MOS transistor in an open loop configuration. The closed loop reference circuit 84 can be monolithically formed on the same chip or die as the plurality of power MOS transistors 68. The closed loop reference circuit 84 includes a reference transistor 86 having a source 88, drain 90 and gate 92. The reference transistor could be a MOS transistor. The source 88 is connected to the ground 94 and the drain 90 is connected to a source of current 96 ($I_{REF}$). The closed loop reference circuit 84 also includes gate driver circuit 98 formed as a push/pull transistor driver circuit connected to the gate 92 of the reference transistor 86. The gate driver circuit 98 includes first and second transistors 100, 102 as is well known to those skilled in the art.

A reference amplifier 104 is connected within the closed loop reference circuit 84 and includes two inputs 106, 108. One of the inputs 106 is connected to the source of current 96 and the drain 90 of the reference transistor 86. The other input 108 is connected to a voltage reference $V_R$. The amplifier output 110 is connected to an input of the gate driver circuit 98, and thus operatively connected to the reference transistor 86. This amplifier output 110 is also connected to each gate driver circuit 78 that is, in turn, connected to its respective power MOS transistor 68. Thus, the reference circuit is operatively connected to the plurality of power MOS transistors in an open loop configuration.

It is evident that the present multiple output driver circuit 66 of the present invention allows better control of the $V_{DS}$ on the power MOS transistors 68. Thus, the gate voltage regulated on the $V_{DS}$ compensates for variations of $R_{DS}$ due to temperature fluctuations. An internal reference cell is proportional but not identical in size to the output power MOS transistors. For example, if the reference transistor 86 is one-tenth the size of the power MOS transistors 68 used as outputs, then the reference circuit 84 would be biased with one-tenth of the current. With the same gate voltage, the circuit would have the same $V_{DS}$ as the larger cells forming the power MOS transistors, which would have the full current through them. Thus, it is possible to regulate internally the $V_{DS}$ with the present invention so that the $V_{DS}$ can be controlled with a 1% or 2% variation as compared to the prior art 10% to 15% variation.

The supply voltage of that gate driver is essentially the $V_{GS}$ that is regulated to close the loop of the $V_{DS}$ on the reference cell. Because the $R_{DS}$ of the device is controlled by gate voltage, and since the device is one die, it matches to a reasonable degree, if two or more power MOS transistors ($Q_1$, $Q_2$ and $Q_X$) are driven with the same gate voltage. The $R_{DS}$ and therefore the $V_{DS}$ (if they are driving similar circuits) will match. The reference transistor 86 is on the same integrated circuit and has the same construction as the other power MOS transistors, but a different number of cells. The reference transistor $R_{DS}$, when driven by the same gate voltage as the power MOS transistors, will be equal to the $R_{DS}$ of the reference transistor multiplied by the ratio of the number of cells in the power MOS transistor to the number of cells in the reference transistor. If the reference transistor is biased "on" by a known current generated from a current reference, then the voltage drop across the reference transistor will be $I_{REF}$ times $R_{DS}$ "on" for the reference transistor. If this voltage is sensed by an amplifier that controls the gate voltage of all the power MOS transistors and compared to a reference voltage, the amplifier will regulate the $R_{DS}$ of the reference transistor directly and the $R_{DS}$ of the power MOS transistors by matching.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that the modifications and embodiments are intended to be included within the scope of the dependent claims.

That which is claimed is:

1. A thermal ink jet printhead system comprising:

a base member having a plurality of ink flow channels that are connected to an ink reservoir and terminate in a nozzle through which ink is expelled in which the base member is part of a thermal ink jet printhead;

a plurality of heating elements, each ink flow channel having a corresponding one of said heating elements connected thereto;

a monolithically integrated multiple output driver circuit formed as a semiconductor integrated circuit and connected to the thermal ink jet printhead, said multiple output driver circuit further comprising:

a plurality power output transistors $Q_1$, $Q_2$ . . . $Q_X$ and gate driver circuits each formed as a push/pull transistor driver circuit, each power output transistor $Q_1$, $Q_2$ . . . $Q_X$ connected to a corresponding one of a push/pull transistor driver circuit, wherein a respective one power output transistor and push/pull transistor driver circuit are connected to a corresponding one heating element;

a single closed loop reference circuit operatively connected in open loop configuration to each push/pull transistor driver circuit, said reference circuit including only one reference transistor and an associated push/pull transistor driver circuit having a gate, drain and source, and only one reference amplifier that receives as inputs a reference voltage from the reference transistor and a source of current, and having an amplifier output operatively connected to said push/pull transistor gate driver circuits of said respective power output transistors and to one of either the source or drain of said push/pull transistor driver circuit of said reference transistor, wherein said reference amplifier regulates the reference transistor directly and the power output transistors by matching; and a logic circuit and controller operatively connected to the gate driver circuits and power output transistors $Q_1$, $Q_2$ . . . $Q_X$ to provide logic pulses for turning on and off each power MOS transistor $Q_1$, $Q_2$ . . . $Q_X$ via an associated push/pull transistor driver circuit.

2. A thermal ink jet printhead according to claim 1, and further comprising a logic circuit operatively connected to said gates of said power output transistor.

3. A thermal ink jet printhead according to claim 2, wherein said logic circuit is monolithically formed with said semiconductor integrated circuit.

4. A thermal ink jet printhead according to claim 1, wherein said heating element connected to each ink flow channel comprises a resistor.

5. A thermal ink jet printhead according to claim 4, wherein said resistors are monolithically formed with said thermal ink jet printhead.

6. A thermal ink jet printhead according to claim 1, wherein said plurality of power output transistors comprise power MOS transistors.

7. A thermal ink jet printhead according to claim 1, wherein each of said power output transistors include a source connected to ground and a drain connected to a voltage supply.

8. A thermal ink jet printhead comprising:

a base member having a plurality of ink flow channels that communicate with an ink reservoir and terminate in a nozzle through which ink is expelled in which the base member is part of a thermal ink jet printhead;

a plurality of heating elements, each ink flow channel having a corresponding one of said heating elements connected thereto;

a monolithically integrated multiple output driver circuit formed as a semiconductor integrated circuit and connected to the thermal ink jet printhead, said multiple output driver circuit further comprising:

a plurality of power output transistors $Q_1, Q_2 \ldots Q_X$ and gate driver circuits each formed as a push/pull transistor driver circuit, each power output transistor $Q_1, Q_2 \ldots Q_X$ connected to a corresponding one of a push/pull transistor driver circuit, wherein a power output transistor and push/pull transistor driver circuit are connected to a corresponding one heating element;

a single closed loop reference circuit operatively connected to each of said push/pull transistor drive circuits in an open loop configuration, said closed loop reference circuit including only one reference transistor having a gate, only one push/pull transistor driver circuit having a gate, source and drain and connected to said gate of said reference transistor, and only one reference amplifier that receives as inputs a reference voltage from the reference transistor and a source of current and including an amplifier output operatively connected to each of said push/pull transistor driver circuits of said power output transistors and to one of either the source or drain of said push/pull transistor driver circuit of said reference transistor, wherein the reference amplifier regulates the reference transistor directly and the power output transistors by matching; and a logic circuit and controller operatively connected to the gate driver circuits and power output transistors $Q_1, Q_2 \ldots Q_X$ to provide logic pulses for turning on and off each power MOS transistor $Q_1, Q_2 \ldots Q_X$ via an associated push/pull transistor driver circuit.

9. A thermal ink jet printhead according to claim 8, and further comprising a logic circuit operatively connected to each push/pull transistor driver circuit of said power output transistor.

10. A thermal ink jet printhead according to claim 9, wherein said logic circuit is monolithically formed with said semiconductor integrated circuit.

11. A thermal ink jet printhead according to claim 8, wherein said heating element connected to each ink flow channel comprises a resistor.

12. A thermal ink jet printhead according to claim 11, wherein said resistors are monolithically formed with said thermal ink jet printhead.

13. A thermal ink jet printhead according to claim 8, wherein each said plurality of power output transistors comprises a power MOS transistor.

14. A thermal ink jet printhead according to claim 8, wherein each of said power output transistors include a source connected to ground and a drain connected to a voltage supply.

15. A multiple output driver circuit formed as a semiconductor integrated circuit comprising:

a semiconductor substrate;

a plurality of power MOS transistors $Q_1, Q_2 \ldots Q_X$ and gate drive circuits each formed as push/pull transistor driver circuits and formed on the semiconductor substrate, each power output transistor $Q_1, Q_2 \ldots Q_X$ connected to a corresponding one of a push/pull transistor driver circuit, and each power MOS transistor $Q_1, Q_2 \ldots Q_X$ and push/pull transistor driver circuit adapted to be respectively connected to a respective load;

a single closed loop reference circuit formed on the semiconductor substrate and operatively connected to each push/pull transistor driver circuit of each power MOS transistor in open loop configuration, said reference circuit including only one reference transistor and an associated push/pull transistor driver circuit having a gate, source and drain, and only one reference amplifier that receives as inputs a reference voltage from the reference transistor and a source of current, and an amplifier output operatively connected to said push/pull transistor driver circuits of said power MOS transistors and either one of the source or drain of said push/pull transistor driver circuit of said reference transistor, wherein the reference amplifier regulates the reference transistor directly and the power MOS transistors by matching; and a logic circuit and controller operatively connected to the gate driver circuits and power output transistors $Q_1, Q_2 \ldots Q_X$ to provide logic pulses for turning on and off each power MOS transistor $Q_1, Q_2 \ldots Q_X$ via an associated push/pull transistor driver circuit.

16. A multiple output driver circuit according to claim 15, and further comprising a logic circuit operatively connected to each gate of said power MOS transistor.

17. A multiple output driver circuit according to claim 15, wherein said logic circuit is monolithically formed with said semiconductor substrate.

18. A multiple output driver circuit according to claim 15, wherein each source of said power MOS transistors is connected to ground and each drain of said power MOS transistors is connected to a voltage supply.

* * * * *